US007214093B1

(12) United States Patent
Capwell et al.

(10) Patent No.: US 7,214,093 B1
(45) Date of Patent: May 8, 2007

(54) BRACKET AND CONNECTOR ATTACHMENT

(75) Inventors: David Capwell, Helens, OR (US); Raul Acevedo, Hillsboro, OR (US); Brian Sackerman, Hillsboro, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 11/529,186

(22) Filed: Sep. 28, 2006

(51) Int. Cl.
*H01R 13/60* (2006.01)

(52) U.S. Cl. ..... 439/540.1

(58) Field of Classification Search ..... 439/607, 439/540.1; 361/759
See application file for complete search history.

(56) References Cited

U.S. PATENT DOCUMENTS 6,478,621 B2 * 11/2002 Ma et al. ..... 439/607
7,112,090 B2 * 9/2006 Caveney et al. ..... 439/540.1

OTHER PUBLICATIONS

"PCI Express Card Electromechanical Specification 1.0a", Sections 6.1 and 6.2, (Apr. 4, 2003), 16 pgs.
"PCT Express Card Electromechanical Specification 1.0a", (Apr. 4, 2003), 3 pgs.
"Talon3008 Product Brief", 2 pgs.

* cited by examiner

*Primary Examiner*—Tho D. Ta
(74) *Attorney, Agent, or Firm*—Douglas J. Ryder; Ryder IP Law, PC

(57) ABSTRACT

In general, in one aspect, the disclosure describes an apparatus that includes a connector mountable to a circuit board and a bracket attached to the connectors. The connector includes at least one port at least one retractable raised portion formed it at least one side of the connector adjacent to a side having a port opening. The bracket includes a front face for abutting against the side of the connector having the port opening and includes a first opening to provide access to the port. The bracket includes at least one side adjacent the front face that has at least one second opening in alignment with the at least one retractable raised portion so as to enable the retractable raised portion to enter the second opening and secure the bracket to the connector.

20 Claims, 8 Drawing Sheets

NOTE:

1. TOLERANCE UNLESS OTHERWISE NOTED ±0,13 [±0.005]

2 THIS FEATURE IS TO PREVENT THE PCI EXPRESS CARD FROM BEING PLUGGED INTO PCI CONNECTORS.

3 THE MOUNTING HOLES AND THE KEEP-OUT AROUND THEM ARE REQUIRED ONLY WHEN THE I/O BRACKET IS MOUNTED TO THE CARD DIRECTLY.

4 CROSS HATCHED AREA REPRESENT COMPONENT & TRACE FREE AREA, SOLDER SIDE (SECONDARY SIDE) ONLY.

NOTES

1. TOLERANCE UNLESS OTHERWISE NOTED ±0,13 [±0.005]

BRACKET AND CONNECTOR ATTACHMENT

BACKGROUND

Computing systems contain many boards, interconnects and/or cards (hereinafter simply referred to as "boards") within an environment (e.g., computer housing, chassis). The systems may include a main board (e.g., server board, mother board, backplane) having other boards connected thereto. The main boards may be capable of receiving multiple different types of other boards (e.g., network interface boards, graphics boards) and the other boards may be capable of being added or removed from the system, possibly while the system is operational without affecting the operation of the overall system (hot swap). The other boards may be perpendicular to the main board if the other boards connect to connectors on the main board. Alternatively, a riser board may be connected perpendicular to the main board and the other boards may connect perpendicular to the riser board and thus be parallel to the main board. The environment may have an opening (or openings) that enable the other boards to be removed therefrom or inserted therein (swapped). The other boards may include a bracket that is connected to the board and holds the board within the environment. The bracket may be used to remove the board from the environment.

The size of the other boards within the system may be based on, among other things, the size of the environment, available room within the environment, openings in the environment for which the connectors or indicators are accessible or with which the boards are swapped, the types of connectors and the location of the connectors on the main board, and the type of computing system. Boards (e.g., network interface, boards) may come in different sizes depending on some subset of the parameters noted above. For example, boards may come in standard sizes and smaller (low profile) sizes for more compact environments. Different standards may apply that define the size and other parameters associated with the other boards depending on the type of computing system and the type of environment.

The other boards may have connectors or indicators that are accessible to outside the environment. The connectors may enable the computing system to connect to peripheral (e.g., printers, monitors) via, for example serial ports, parallel ports, or USB connectors. The connectors may enable the computing system to communicate with other devices (e.g., networks, LAN, Internet) via, for example, RJ-45 connectors, RJ-11 connectors or coaxial cable connectors. The size of the board, the computing environment, and any standards that apply thereto may affect the number of connectors that can be located on the board for connections external to the environment.

BRIEF DESCRIPTION OF THE DRAWINGS

The features and advantages of the various embodiments will become apparent from the following detailed description in which.

DETAILED DESCRIPTION

Figure 1:
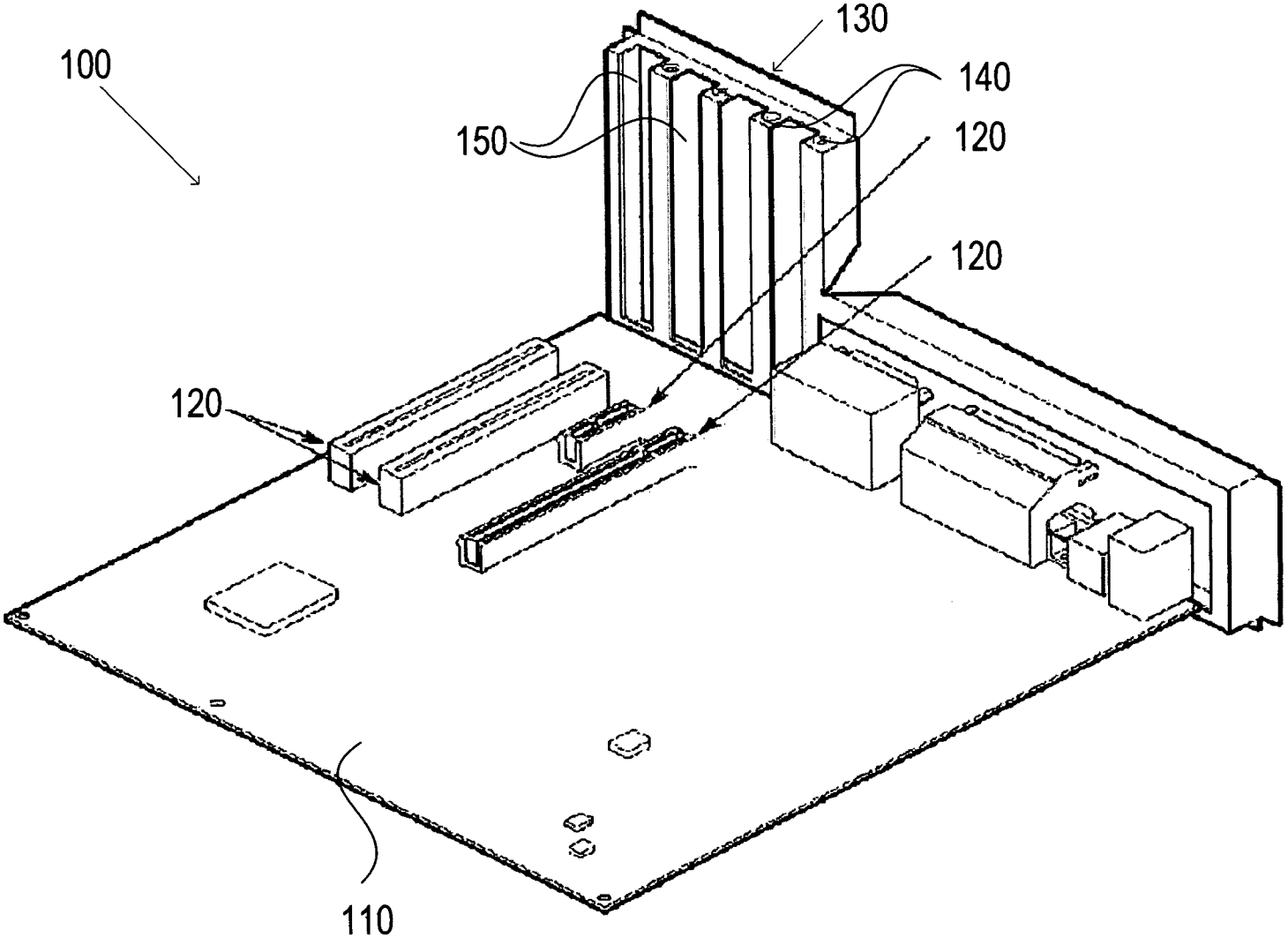
FIG. 1 illustrates a perspective view of an example computing system, according to one embodiment.

FIG. 1 illustrates a perspective view of an example computing system 100. The system 100 includes a main board 110 having at least one connector 120 for holding additional (add-on) boards. The system 100 resides within a housing (only back wall illustrated). The housing may include a grate 130 for securing the add-on boards to the housing. The grate 130 may include rails 140 for supporting the add-on boards and connecting the add-on boards to the housing and openings 150 for enabling the add-on boards to be accessed external to the housing. The add-on boards may include connectors or indicators that can be accessed external to the housing.

As illustrated, the main board 110 is placed horizontally on the bottom of the environment. The add-on boards are not illustrated in FIG. 1 to simplify the figure, but could be mounted to a connector 120 and extend vertically from the main board 110 and extend toward the back of the housing where it is supported and possibly connected to the rails 140. Any connectors or indicators on the edge of the add-on board may be accessible through the openings 150.

Alternatively, a riser card may be mounted to the main board 110 and extend vertically therefrom, and the add-on cards may be mounted to the riser card and extend horizontally therefrom so as to be substantially parallel to the main board 110. For this embodiment the rails 140 and openings 150 in the grate 130 would have to extend horizontally.

The main board is not limited to being placed horizontally within the environment with the add-on boards being placed above the main board (either vertically or horizontally using a riser card). For example, if the main board was a backplane in a router or switch it may be mounted vertically on the back end of a rack and the add-on boards would extend either vertically or horizontally therefrom (depending upon the configuration of the connectors on the board).

Figure 2A:
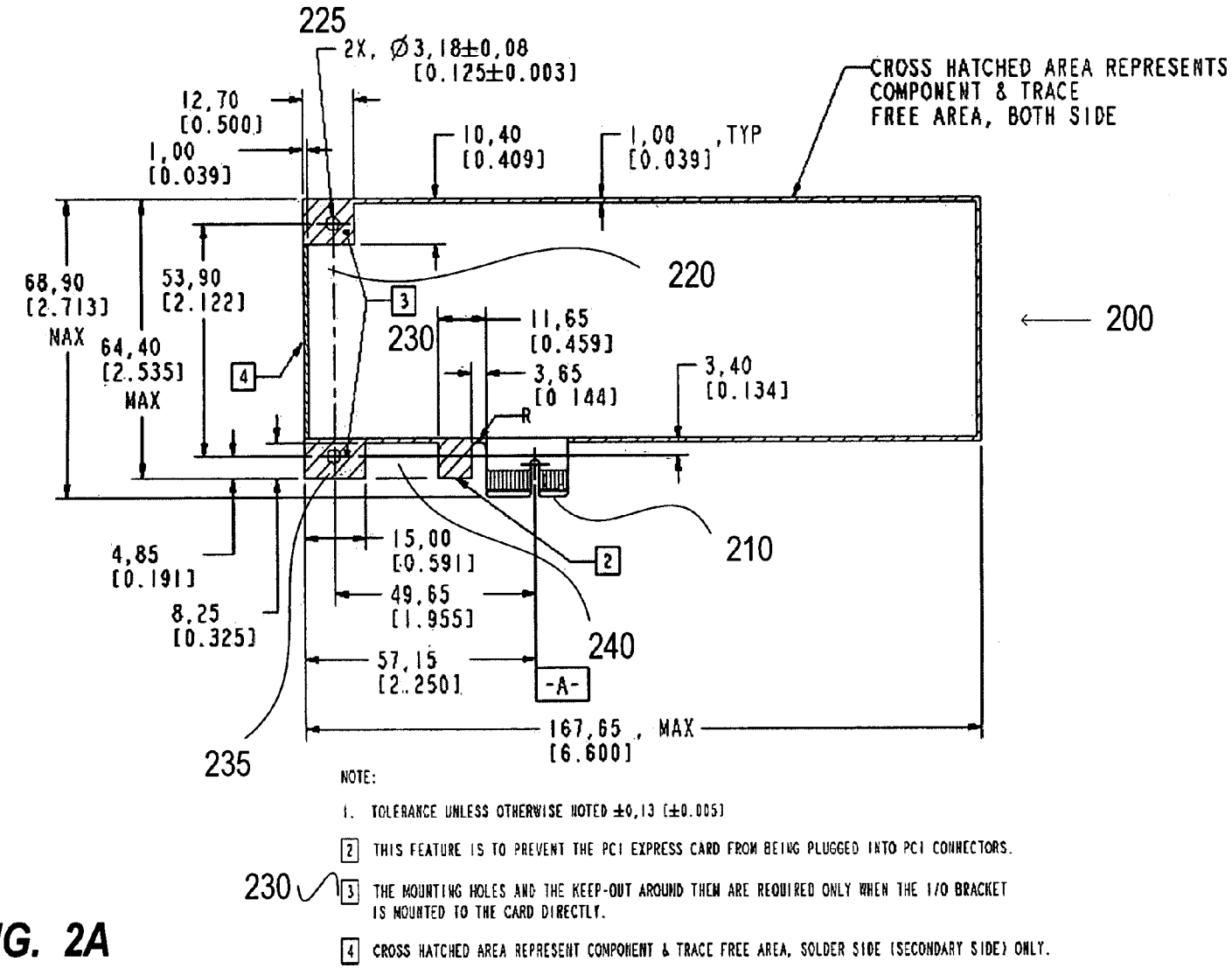
FIGS. 2A–B illustrate an example add-on board and bracket that may be used in a computing environment, according to one embodiment.
Figure 2B:
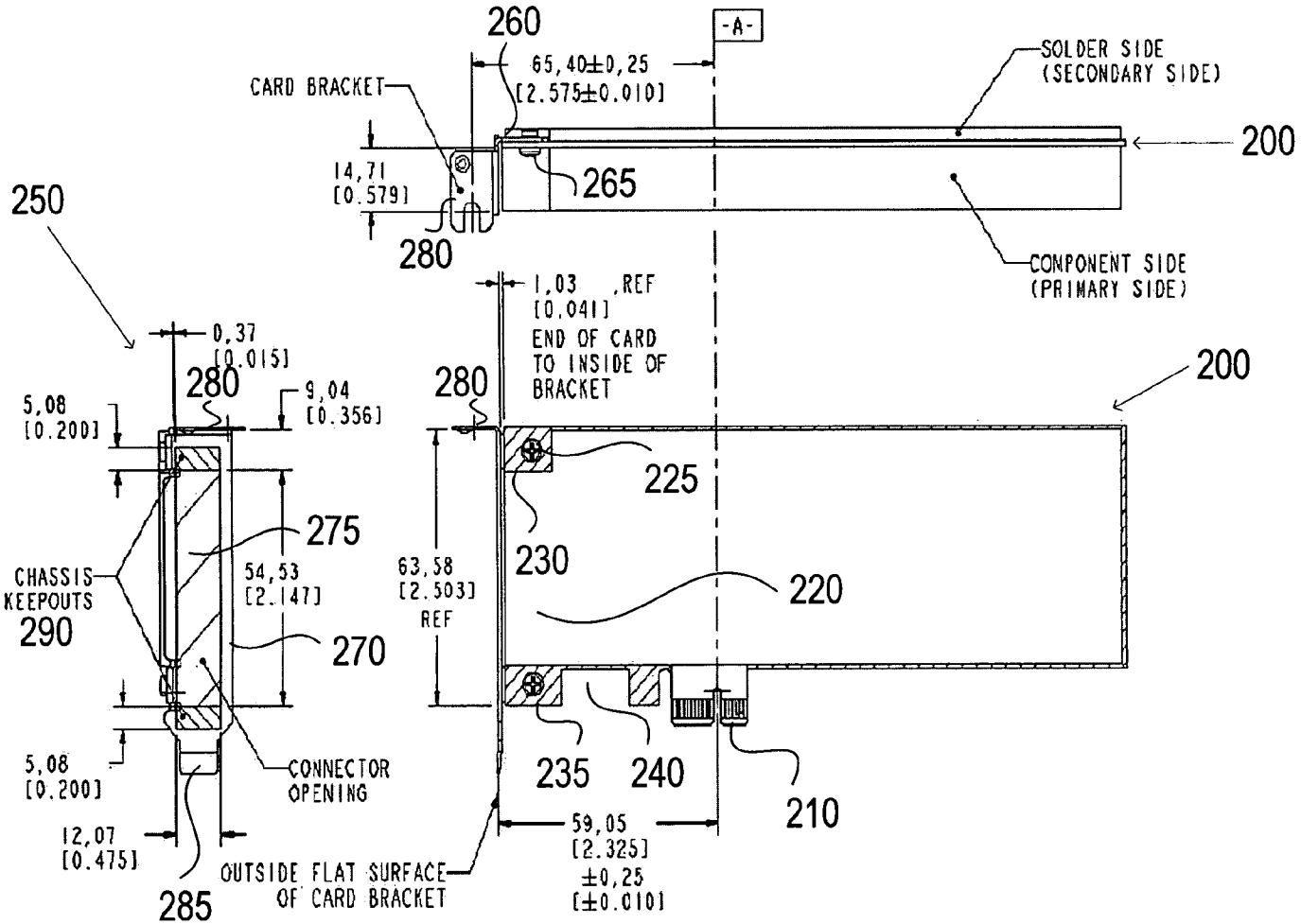
Figure 3:
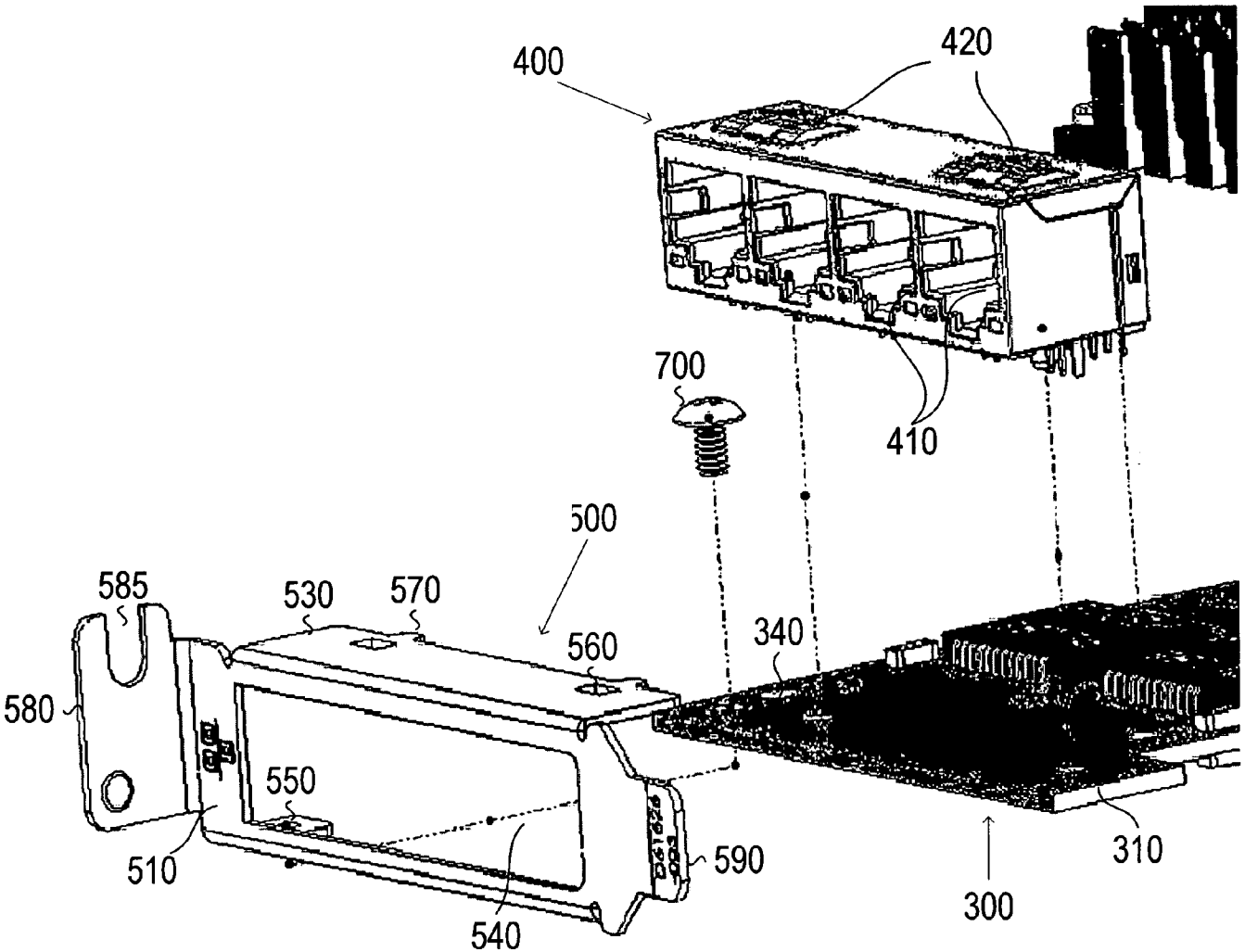
FIG. 3 illustrates a front exploded view of an example connector and bracket for mounting to a board, according to one embodiment.
Figure 4:
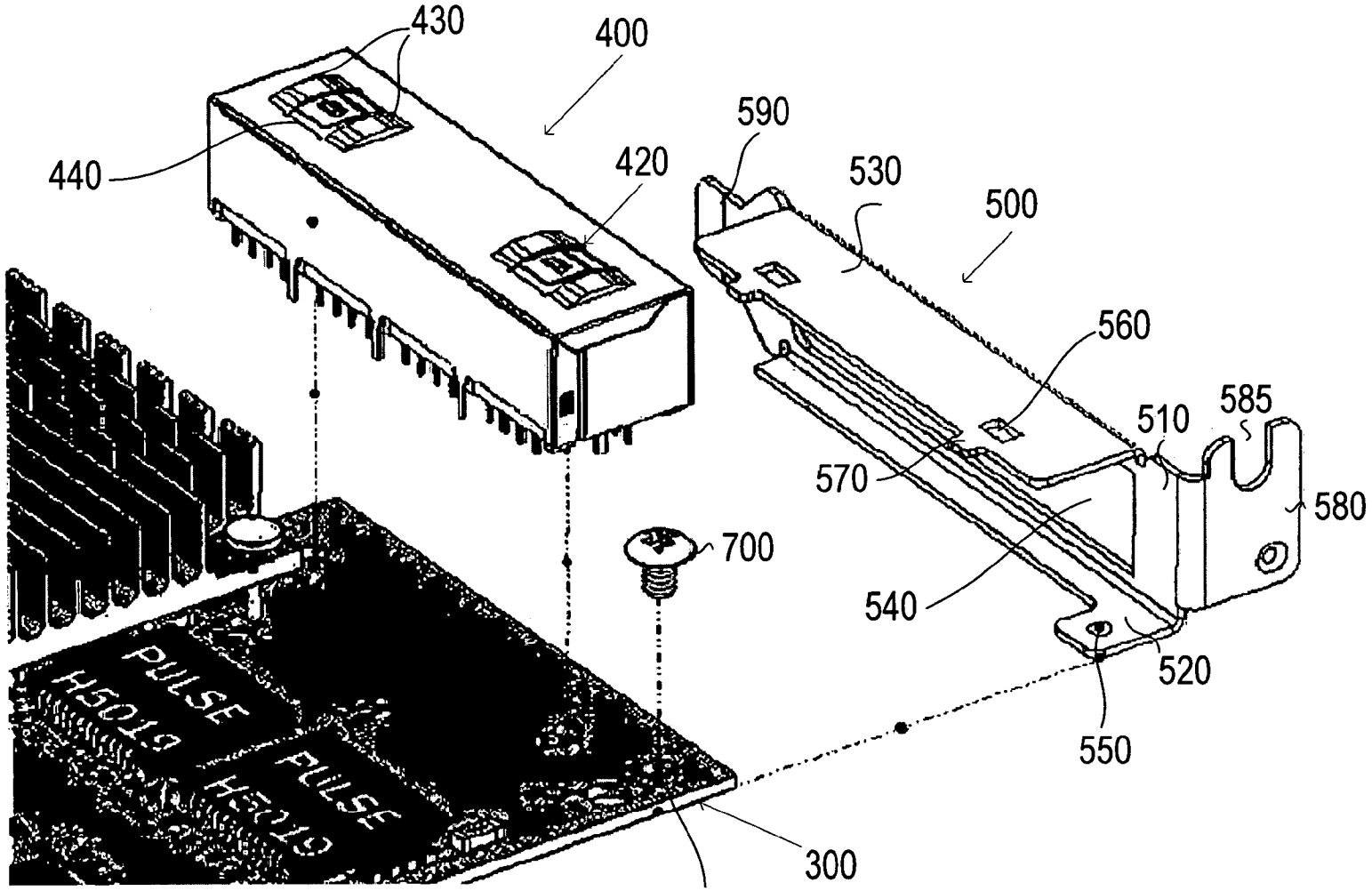
FIG. 4 illustrates a rear exploded view of an example connector and bracket for mounting to a board, according to one embodiment.
Figure 5:
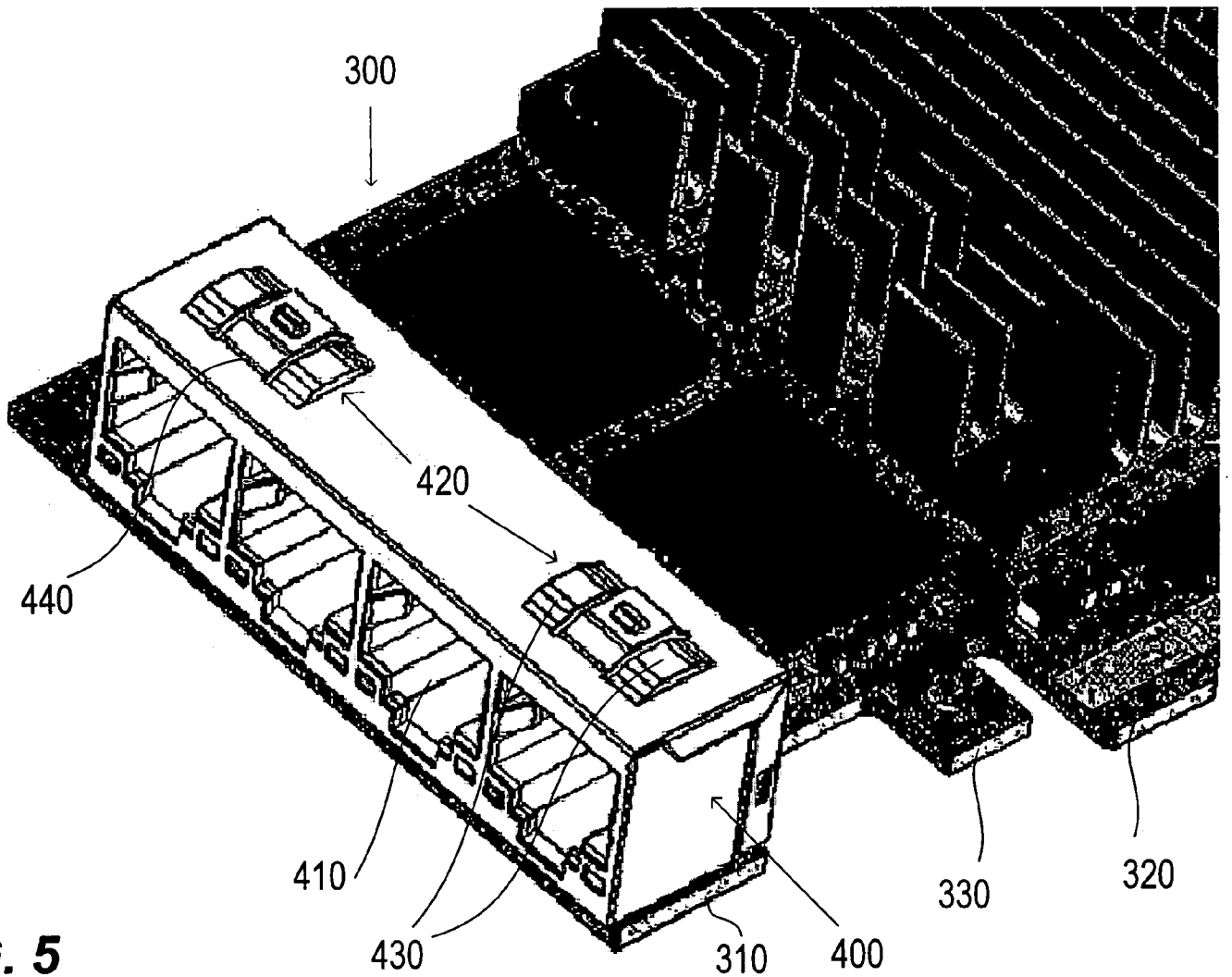
FIG. 5 illustrates a front perspective view of an example connector mounted to a board, according to one embodiment.
Figure 6:
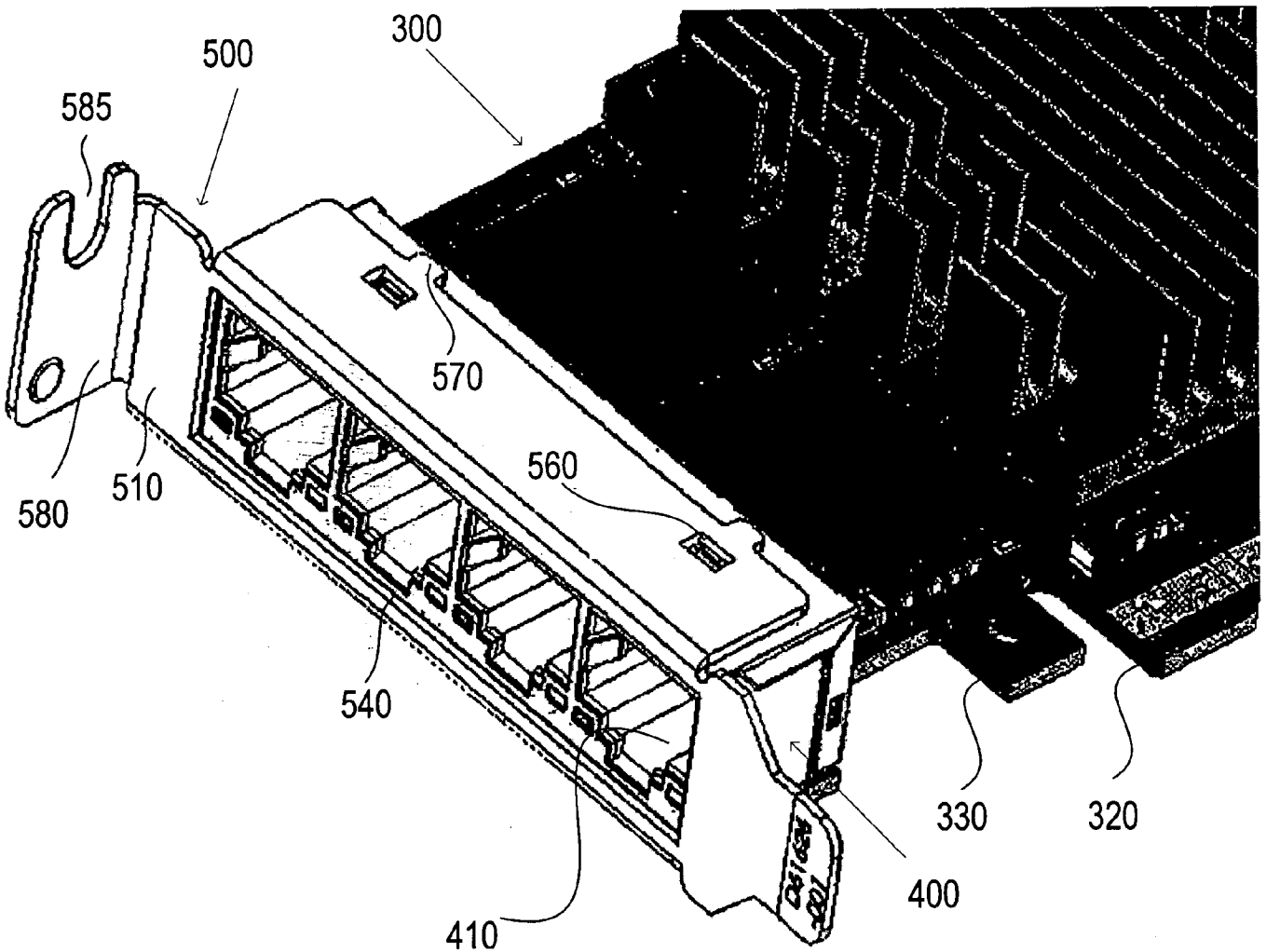
FIG. 6 illustrates a front perspective view of an example connector and bracket mounted to a board, according to one embodiment.
Figure 7:
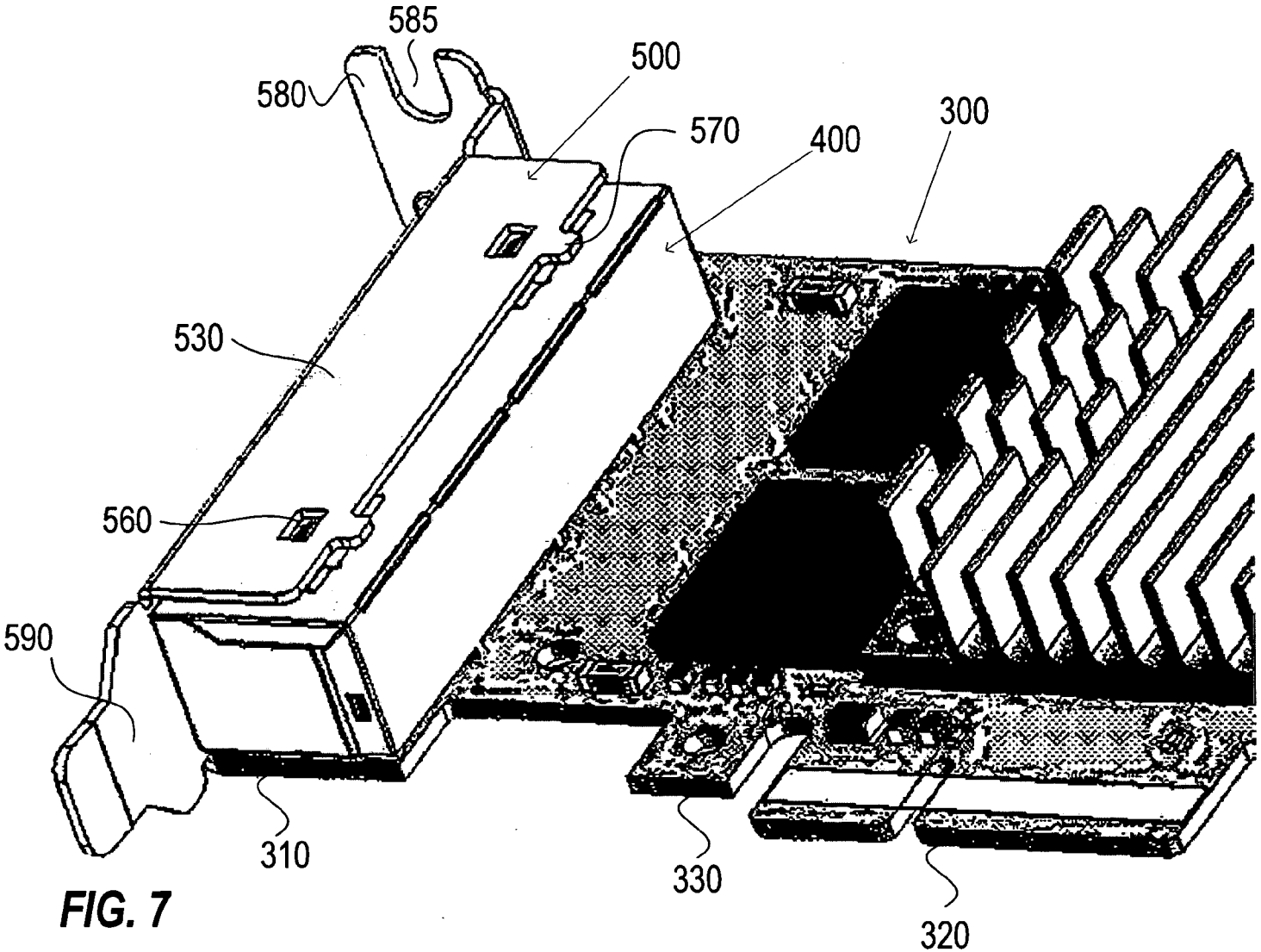
FIG. 7 illustrates a rear perspective view of an example connector and bracket mounted to a board, according to one embodiment.

FIGS. 2A–B illustrates an example add-on board 200 and bracket 230 that may be used in a computing environment. The board 200 may include a connector 210 for connecting to the main board (e.g., 110 of FIG. 1). The connector 210 may be formed in an edge of the board 200 so that it can connect to a connector (e.g., 120) on the main board. Alternatively, a connector may be mounted to the board 200 and extend from an edge of the board 200. As illustrated, the connector 210 is on a lower edge of the board 200 but is in no way limited thereto. Rather the connectors could extend from any edge. For example, for the router/switch noted above the connector may be on the back edge of the board so that it could be used to connect the board into the backplane when the board is inserted in the rack.

The connector 210 extends from the edge of the board 200 so that the connector can be inserted into the connector on the main board without the edge of the board interfering. When the add-on board 200 is connected to the main board the lower edge of add-on board 200 will be above the main board by a certain amount so as not to interfere with the main board. A front portion 220 of the board may have an extended lower edge as well. The front portion 200 is where connectors or other indicators are located and are accessible external to the environment that the boards are located.

The bracket 250 may be used for connecting the board 200 to the housing (e.g., grate 130). The bracket 250 may include a lower edge 260 and a faceplate 260 extending perpendicular to the board 200. The lower edge 260 may include holes (not illustrated) that are in alignment with holes 225 in the front portion 220 of the board 200 to secure the bracket 250 to the board 200 with, for example, screws 265. The holes 225 may be in the upper and lower corners so that the bracket 250 is secured to the board 200 at both ends. The faceplate 270 may include an opening 275 so that any connectors or indicators on the board 200 are visible outside the housing. The faceplate 270 may include a first tab 280 extending perpendicular to the faceplate 250 on one edge and a second tab 285 extending past the board 200 on the other edge.

The number of connectors (or ports within a connector) that can be utilized on a board 200 may be controlled by, among other things, the size and type of board 200 and the size of the opening 275. These parameters may be controlled by standards related to boards, chassis' and/or systems, or the specifications for the particular system.

For certain boards (e.g., network interface boards) the number of ports within a connector may be a power of two (e.g., 2, 4, 8). Therefore, if a board is just to small to fit a particular number of ports the number of ports on the board may be reduced in half (e.g., from 4 to 2).

By way of example, the board 200 and the bracket 250 illustrated in FIG. 2 are PCI Express low profile compliant, the physical parameters of which are governed by the PCI Express Card Electromechanical Specification, Revision 1.0a, published Apr. 15, 2003 (hereinafter referred to as "the PCIe specification"). The physical parameters illustrated for the board 200 and the bracket 250 effect the type of connectors and number of ports capable of being placed on the board.

For example, a PCIe low profile bracket has an opening 275 of 2.147 inches (plus or minus tolerances) so that any connector could not be any longer than that. The PCIe low profile bracket includes a chassis keepout area of 0.2 inches associated with each edge of the board. The keepout area associated with the upper edge means that a connector could not utilize that portion of the board. If mounting holes 225 are used on either the upper or lower edges there is a keepout area 230 defined therearound so that a connector could not utilize this area. The front portion of the board 220 includes a tab 235 extending 0.325 inches past the lower edge of the board, however the tab is only 0.591 inches in width thus limiting the width of a connecter that could use this area as the connector can not extend into the gap 240 formed behind the tab 235.

FIGS. 3–7 illustrate different views of a board 300 having an example connector 400 and bracket 500 mounted thereto. Use of the connector 400 and the bracket 500 can increase the number of ports capable of being mounted on the board 300 and accessible outside of the computing environment. FIGS. 3–7 illustrate a PCI Express low profile compliant board having a four port RJ-45 connector mounted thereto. The PCI Express low profile physical parameters, such as those illustrated in FIGS. 2A–B, are not illustrated in FIGS. 3–7 but are understood to apply.

The board 300 includes a front portion having a tab 310 extending from a lower edge and a connector 320 extending from a lower edge for connecting to a main board. The board 300 may also include a tab 330 on the lower edge (e.g., between the connector 320 and the tab 310) to prevent the board 300 from being plugged into the wrong type of connectors (e.g., prevent a PCI Express board from being plugged into a PCI connector). The front portion of the board 300 may include a hole 340 for accepting a screw 700 to secure the bracket 500 to the board 300.

The connector 400 has a number of ports 410 (e.g., 4) formed therein. The connector includes pins for connecting to the board 300 and may include rods for aligning the connector 400 with the board 300 by placing the rods in holes in the board 300. The connector 400 includes at least one retractable raised portion (snap) 420 on the top surface of connector 400. The snaps 420 may be retracted if pressure is applied. The snaps 420 may be spring loaded or may be made of a flexible material. The snaps 420 are used to connect to the connector 400 to the bracket 500.

The snaps 420 may be arced to aid in getting the bracket 500 over the snaps 420. The snaps 420 may include stationary portions 430 on each side and a retractable portion 440 in the middle. The stationary portions 430 may help raise the bracket 500 onto the retractable portion 440.

The bracket 500 includes a front face 510, a bottom face 520 and an upper face 530. The front face 510 includes an opening 540 formed therein for providing access to and/or accepting the connector 400. The lower face 520 may include a hole 550 for accepting a screw 700 to connect the bracket 500 to the board 300. The upper face 530 includes holes 560 in alignment with the snaps 420 to receive the snaps 420.

The upper face 530 may also include tabs 570 in alignment with the holes 560. The tabs 570 from a spare bracket would be in alignment with the holes 560 in a bracket 500 connected to the connector 400 and thus could be used to push down the snaps 420 and enable the bracket 500 to be removed from the connector 400. According to one embodiment, each board 300 may come with a low profile bracket and a standard height bracket and the bracket used depends on the system the board 300 is being placed in.

Alternatively, the tabs 570 on a mounted bracket 500 may be utilized to retract the snaps 420 so that the bracket 500 can be removed from the connector 400. For example, the tabs 570 may be pushed down so that the retractable portion 440 is retracted so that the snaps 420 are no longer in the holes 560 and the bracket 500 can be removed from the connector 400. Alternatively, the tabs 570 can be used to help lift the bracket 500 up so that the snaps 420 are no longer in the hole 560 and the bracket 500 can be removed from the connector 400.

The front face 510 may include a tab 580 on one side that extends perpendicular therefrom. The tab 580 may include a screw hole 585 for connecting the bracket 500 via a screw to the environment that the board 300 is within. The front face 510 may extend past the board 300 on the opposite side to create a tab 590 that may be used for removing the board 300 from the environment.

The connector 400 is mounted to the front portion of the board 300 including within the tab 310 and does not extend into the opening (e.g., 240) behind the tab 310. The connector 400 may extend over a front edge of the board 300 by an allowable amount. The bracket 500 is to be secured to the upper edge of the board 300 so the connector 400 is not mounted within the keep-out area (e.g., 230) around the hole 340 or the chassis keepout area (e.g., 290).

The bracket 500 is connected to the connector 400 by placing the bracket 500 over the connector 400 with the upper face 530 extending over the upper surface of the connector 400, the bottom face 520 extending below the front edge of the board 300 and the opening 540 surrounding the ports 410. The top face 520 of the bracket 500 is secured to the connector 400 by sliding the bracket 500 over the connector 400 until the snaps 420 in the connector 400 are within the holes 560 in the upper face 530 of the bracket 500. The hole 550 in the lower face 520 should begin alignment with the hole 340 in the board 300. The bracket 500 is then secured to the board 300 using a screw 700. The bracket 500 is secured to the board 300 to help prevent the bracket 500 from rotating. The connection of the bracket 500 and the connector 400 assists in securing the bracket 500 and the board 300, thus enabling less connectivity between the board 300 and the bracket 500 (e.g., only connected on upper edge).

The various embodiments described above with respect to FIGS. 3–7 are not limited to those illustrated. For example, the connector 400 and bracket 500 are illustrated as connecting via two snaps 440 and two holes 560 located on top surfaces but are not limited to the number or location of the snaps 440 and holes 560. For example, it is possible that one larger snap/opening could be utilized in the middle of the connector/bracket or a third snap/opening could be added in the middle without departing from the scope. Likewise, the sides of the connectors/brackets could include snaps/openings in place of or in addition to the snaps/openings on the upper surface.

The connection between the bracket 500 and connector 400 is illustrated as being snaps 440 and holes 560 but is not limited thereto, rather it could be any secure and easy to connect/disconnect connection. For example, the bracket could include snaps extending down and the connector could include openings for receiving the snaps (as long as the opening did not interfere with the ports). The connector could include a tab extending therefrom and the bracket could include a grove with a retractable opening for accepting the tab.

The bracket 500 is illustrated as being connected to the board 300 with a screw 700 but is not limited thereto. Rather the bracket 500 could be secured to the board 300 via other connections (e.g., clip, pin) or may not be connected to the board 300 (if the bracket 500 is secured sufficiently to the connector 400 and the connector 400 is secured to the board 300) without departing from the scope.

The various embodiments illustrated in FIGS. 3–7 and described above were based on PCI express low profile boards and brackets and four port RJ-45 connectors. However, the various embodiments described herein are not limited to PCI Express low profile parameters, RJ-45 connectors, or the number of ports, let alone a four port PCI Express low profile board/bracket. Moreover, the various embodiments are in no way intended to be limited by the PCI express specification or any standards for that matter. Rather, the various embodiments described herein may be applicable to any boards utilizing connectors and brackets in this manner or other manners connectors. Utilizing the different embodiments described above to connect the bracket and connector to the board provides additional space on the board for the connector.

Although the disclosure has been illustrated by reference to specific embodiments, it will be apparent that the disclosure is not limited thereto as various changes and modifications may be made thereto without departing from the scope. Reference to "one embodiment" or "an embodiment" means that a particular feature, structure or characteristic described therein is included in at least one embodiment. Thus, the appearances of the phrase "in one embodiment" or "in an embodiment" appearing in various places throughout the specification are not necessarily all referring to the same embodiment.

The various embodiments are intended to be protected broadly within the spirit and scope of the appended claims.

What is claimed:

1. An apparatus comprising a network interface connector mountable to a circuit board, wherein said connector has a body and at least one port formed therein, and wherein the body includes at least one retractable raised portion on at least one side adjacent to a side having a port opening;

a bracket attachable to said connector, wherein said bracket includes a front face for abutting against the side of said connector having the port opening, wherein the front face includes a first opening to receive the port, wherein said bracket includes at least one side adjacent the front face that has at least one second opening in alignment with the at least one retractable raised portion so as to enable the retractable raised portion to enter the second opening and secure said bracket to said connector.

2. The apparatus of claim 1, wherein the retractable raised portion is on a top surface of said connector and the second opening is on a top surface of said bracket.

3. The apparatus of claim 1, wherein the retractable raised portion is arced and includes stationary portions on each side and a retractable portion in the middle.

4. The apparatus of claim 1, wherein said bracket is mountable to the circuit board.

5. The apparatus of claim 4, wherein said bracket includes a third hole in alignment with a hole in the circuit board and is mounted to the circuit board by inserting a screw through the aligned holes.

6. The apparatus of claim 1, wherein said bracket further includes at least one tab in alignment with the at least one second opening, and wherein the tab is used to disengage the retractable raised portion and the second opening.

7. The apparatus of claim 1, wherein said connector is mounted within a tab on lower edge of said board and does not extend into gap behind the tab.

8. The apparatus of claim 7, wherein the tab is in the range of 0.586 and 0.596 inches long.

9. The apparatus of claim 1, wherein the first opening is in the range of 2.142 to 2.152 inches long.

10. The apparatus of claim 1, wherein said connector is a four port RJ-45 connector mountable to a PCI express low profile compliant board and said bracket is a PCI express compliant bracket.

11. A PCI express low profile compliant board comprising a four port RJ-45 connector mounted to the board, wherein said connector includes at least one retractable raised portion on at least one side adjacent to a side having port openings; and a bracket attachable to said connector, wherein said bracket includes a front face for abutting against the side of said connector having the port openings, wherein the front face includes a first opening to receive the ports, wherein said bracket includes at least one side adjacent the front face that has at least one second opening in alignment with the at least one retractable raised portion so as to enable the retractable raised portion to enter the second opening and secure said bracket to said connector.

12. The board of claim 11, wherein the retractable raised portion is on a top surface of said connector and the second opening is on a top surface of said bracket.

13. The board of claim 11, wherein said bracket includes a third hole in alignment with a hole in said board and is secured to said board by inserting a screw through the aligned holes.

14. The board of claim 11, wherein said bracket is a PCI express low profile compliant bracket or a PCI express standard height compliant bracket.

15. The board of claim 11, wherein said connector is mounted within a tab on lower edge of said board.

16. The board of claim 11, wherein said connector extends over front edge of said board.

17. A system comprising a frame;

a main board; and at least one add-in board connected to the main board, wherein the add-in board includes a connector formed in a lower edge of said add-in board to provide connectivity to a connector in said main board;

a connector mounted to a front portion of the add-in board, wherein the connector has a body and at least one port formed therein, and wherein the body includes at least one retractable raised portion on a top surface of the connector; and a bracket attachable to the connector, wherein the bracket includes a front face for abutting against the side of the connector having the port opening, wherein the front face includes a first opening to receive the port, wherein the bracket includes a top surface having at least one second opening in alignment with the at least one retractable raised portion so as to enable the retractable raised portion to enter the second opening and secure the bracket to the connector, wherein the bracket also includes a tab extending from the front face to secure the bracket to said frame.

18. The system of claim 17, wherein the bracket includes a third hole in alignment with a hole in said add-in board and is securable to said add-on board by inserting a screw through the aligned holes.

19. The system of claim 17, wherein the add-in board is a PCI express low profile compliant board and the connector is a four port RJ-45 connector.

20. The system of claim 19, wherein the bracket is interchangeable between a PCI express low profile compliant bracket and a PCI express standard height compliant bracket.

* * * * *